United States Patent [19]

Möller et al.

[11] Patent Number: 4,940,172

[45] Date of Patent: Jul. 10, 1990

[54] FILLING APPARATUS FOR FILLING A CONTAINER WITH A MEASURED AMOUNT OF A LIQUID, PASTY OR LUMPY PRODUCT

[75] Inventors: Dieter Möller, Haan; Georg Fischer, Velbert, both of Fed. Rep. of Germany

[73] Assignee: Benz & Hilgers GmbH, Dusseldorf, Fed. Rep. of Germany

[21] Appl. No.: 307,671

[22] Filed: Feb. 6, 1989

[30] Foreign Application Priority Data

Feb. 4, 1988 [DE] Fed. Rep. of Germany ..... 3803230

[51] Int. Cl.[5] ..... B67D 3/00; B67D 5/06

[52] U.S. Cl. ..... 222/505; 222/504; 141/264

[58] Field of Search ..... 222/504, 505, 544, 559–561; 99/450.9; 141/237, 264, 392; 251/326, 329

[56] References Cited

U.S. PATENT DOCUMENTS

| | | | |
|---|---|---|---|
| 2,826,344 | 3/1958 | Weber | 222/561 |
| 3,866,806 | 2/1975 | Shapland, Jr. | 222/561 |
| 3,937,372 | 2/1976 | Bode, Jr. | 222/561 |
| 4,252,299 | 2/1981 | LoBue | 222/561 |
| 4,445,548 | 5/1984 | Neumann | 141/264 |
| 4,691,627 | 9/1987 | Roberts | 99/450.6 |

FOREIGN PATENT DOCUMENTS

| | | |
|---|---|---|
| 2311193 | 3/1973 | Fed. Rep. of Germany . |
| 2163052 | 7/1973 | France . |

*Primary Examiner*—Michael S. Huppert
*Assistant Examiner*—Steven Reiss
*Attorney, Agent, or Firm*—Herbert Dubno

[57] ABSTRACT

The filling apparatus for filling a measured amount of liquid, pasty or lumpy product into a container has at least one mouthpiece, which can be opened or closed by a closure member for its filling duct formed as a cutoff band so that an exactly defined amount of product is delivered and simultaneously a satisfactory shut off of the product flow is obtained, whereby filament or drop formation is effectively prevented.

16 Claims, 2 Drawing Sheets

FIG.1
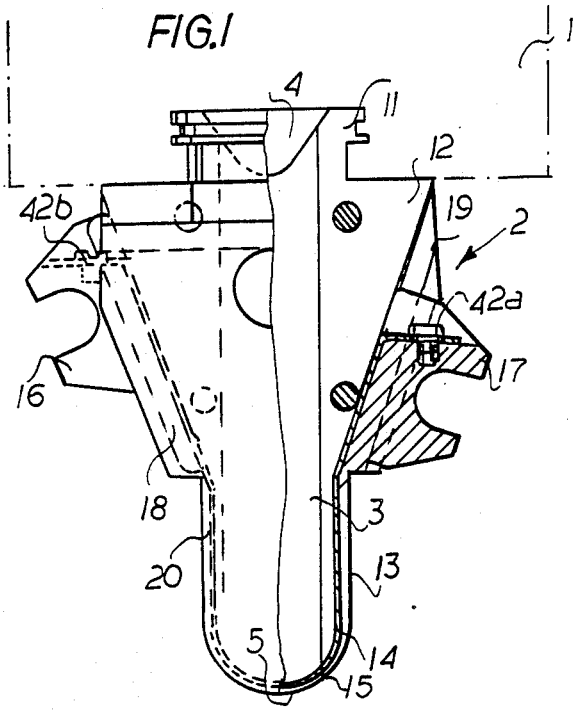
FIG.3
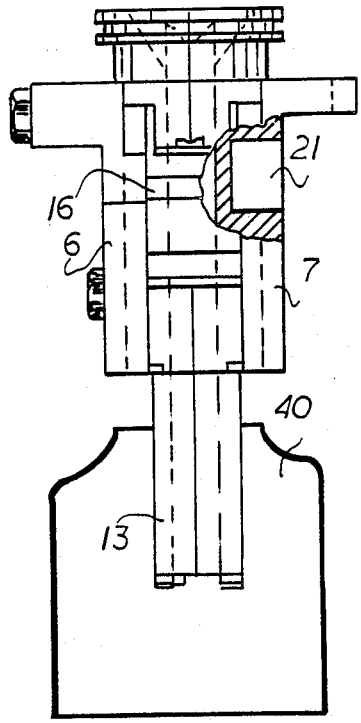
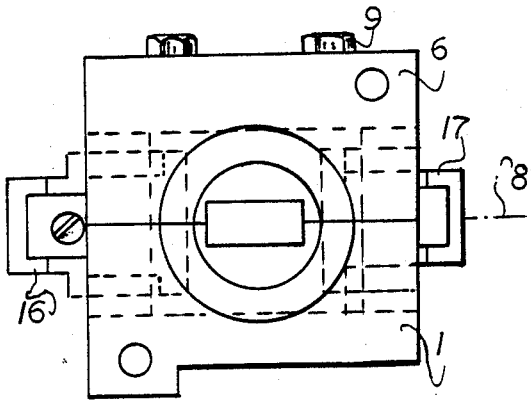
FIG.2

FILLING APPARATUS FOR FILLING A CONTAINER WITH A MEASURED AMOUNT OF A LIQUID, PASTY OR LUMPY PRODUCT

FIELD OF THE INVENTION

Our present invention relates to a filling apparatus for a flowable product and, more particularly, to a filling apparatus which fills containers with measured amounts of liquid, pasty or lumpy products, i.e. a relatively viscous liquid.

BACKGROUND OF THE INVENTION

A filling apparatus having a mouthpiece with at least one filling duct whose outlet mouth is closable by a closure member is known.

A metering mechanism is known which provides a measured amount of product. The closure members in these devices are constructed in different ways. Independently of their structure these closure members have the purpose of forming the lower cutoff for the mouthpiece, under which containers, e.g. packing cups, are moved past cyclically on a conveyor belt of a filling unit. As soon as a container comes to rest, the closure member opens the outlet mouth of the mouthpiece so that the product can enter the container found under it through the mouthpiece. When the filling process is finished, the outlet mouth is again closed and the conveyor belt advances another cycle until the mouthpiece is above the next empty container.

Filling machines or units are known for pasty or lumpy products in which the mouthpiece is equipped with a rotary stopcock as the closure member. The rotary stopcock is rotatably mounted in the mouthpiece and it has a passage approximately the size of the filling duct of the mouthpiece. The passage can be brought into alignment with the filling duct, so that the filled product can flow into the container. If the rotary stopcock is rotated about 90 degrees, the closure member is closed. These rotary stopcock mouthpieces are quite costly, since for exact sealing an exact mounting must be made of the rotary stopcock in the mouthpiece.

For filling very hard products there are mouthpieces with the so-called "wire-cutters". "Wire cutters" comprise a wire and/or a wire bow, which can be moved past and beneath the outlet mouth and thus cut away a strand of product. These wire cutters have the considerable disadvantage that they can only cut off the product flow, but they cannot relieve the pressure on the remaining product. Apart from that, these wire cutters are frequently damaged and must be replaced.

OBJECT OF THE INVENTION

It is the principal object of the invention to provide a filling apparatus which provides a precise, definite limit to the amount of product filled into a container and an exact closure of the outlet mouth after the metering process without thread or drop formation.

SUMMARY OF THE INVENTION

This object and others which will become more readily apparent hereinafter is attained in accordance with our invention in a filling apparatus having a mouthpiece with at least one filling duct whose outlet mouth is closable by a closure member.

According to our invention, the closure member is formed by at least one cutoff band or strip of metal. An exact severing of a strand of product is possible with the means according to our invention and furthermore an exact closing is guaranteed of the outlet mouth of the mouthpiece. The cutoff band, which is advantageously flexible and is guided in a passage in the vicinity of the outlet mouth of the mouthpiece, is characterized by a simple, economical manufacture and assembly and has a long lifetime. The closure by the cutoff band may be so exact that, in any case, the thread and/or drop formation is prevented in any case.

By "cutoff band" we mean a substantially flat band or longitudinally-extended strip which may have one or more openings or permeable windows in it. These openings or windows are advantageously rectangular having well-defined edges.

The passage for the cutoff band can be located in a pin-like rounded outlet piece of the mouthpiece, so that the cutoff band is slidable in and opposite the transport direction of the container of the filling machine or unit in the vicinity of the outlet mouth of the mouthpiece. The cutoff band may move like a tongue in the vicinity of the outlet mouth, whereby it then alternately closes and then opens the outlet mouth. A closure member constructed like this allows a completely satisfactory filling of the container.

The flexible cutoff band can be constructed from various materials. It can advantageously be made from steel strip, especially a stainless steel strip.

A carriage slidably mounted in a guide of the mouthpiece, which is connected with the cutoff band at its end facing away from the outlet mouth, is especially suitable for driving of the cutoff band. Thus, the guide may be formed advantageously like a T-groove and located in a supporting member of the mouthpiece connected to the pin-like outlet piece.

The mouthpiece housing is divided at the symmetry axis of the T-groove to easily form the passage for the cutoff band and the T-groove for the carriages. Both housing halves may be detachably secured by screws or the like with each other.

Instead of a cutoff band, which opens or closes the outlet mouth of the mouthpiece with its free ends, a cutoff band can also be provided, which is connected at each of its free ends with a carriage and in its central region associated with the outlet mouth is provided with at least one permeable window. This permeable window has about the same dimensions as the cross section of the filling duct, which can have an increasingly larger cross section for easy delivery of the product over its length extending from an entrance mouth to the outlet mouth of the mouthpiece.

A carriage may also be provided with a cutoff band, which can either be pushed or overlapped at the outlet mouth to open or close the outlet mouth.

One carriage may be mechanically driven and the other can be spring-loaded so that, when two carriages are present, these can be moved alternately in the one or the other direction, so that the outlet mouth can be closed or opened by the cutoff band.

A common twin-arm operating lever may be provided for driving the carriages, so that suitably the carriages may be provided with open receptacles on one side and the twin-arm operating lever may be provided with bolts each of which engage in a receptacle. The operating lever itself may be mounted on a central supporting shaft extending transverse to the motion direction of a container, a mouthpiece being located at each of its ends, so that a common drive and two cutoff bands can simultaneously close or open two mouthpieces.

BRIEF DESCRIPTION OF THE DRAWING

The above and other objects, features and advantages of our invention will become more readily apparent from the following description, reference being made to the accompanying drawing in which:

FIG. 1 is a partially longitudinal cross sectional view through a mouthpiece of a portion of a filling apparatus according to our invention with two alternately movable carriages;

FIG. 2 is a top view of the apparatus shown in FIG. 1;

FIG. 3 is a side elevational view of the apparatus shown in FIG. 1 partly broken away;

SPECIFIC DESCRIPTION

Figures 4, 5, 6:
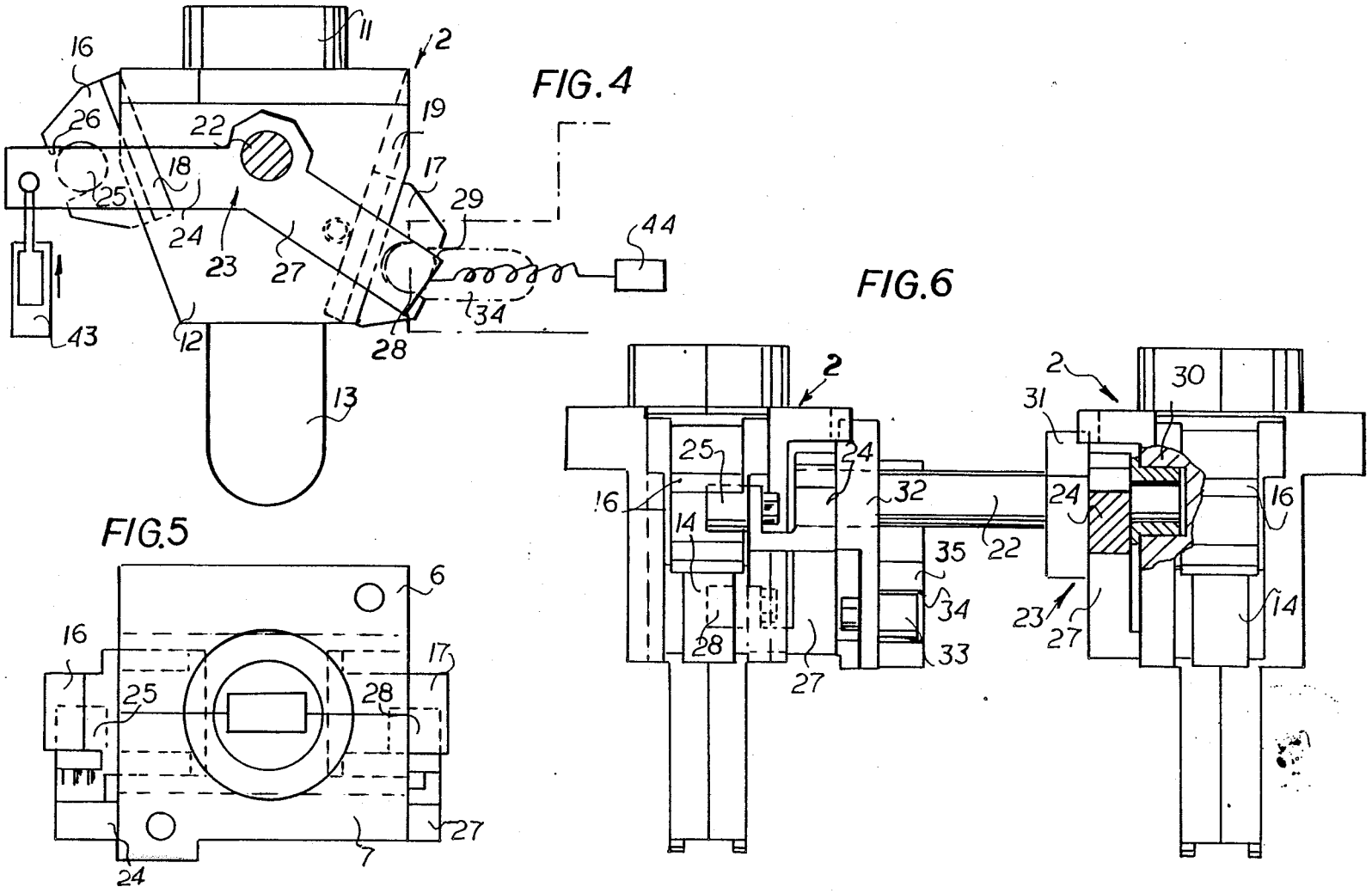
FIG. 4 is a side elevational view of the mouthpiece with an associated operating mechanism corresponding to that of FIG. 1, partly in section.
FIG. 5 is a top view of the apparatus shown in FIG. 4.
FIG. 6 is a side elevational view, partially broken away, of two mouthpieces mounted parallel to each other.

As set forth in FIGS. 1 to 3 the filling apparatus suitable for filling a measured amount of a liquid, pasty or lumpy product into a container 40 basically comprises a metering housing 1 indicated with dot-dashed lines and a mouthpiece 2 mounted under it.

The mouthpiece 2 has a filling duct 3, which, as indicated in FIG. 2, has a substantially rectangular cross section.

To permit an improved flow of the product through the mouthpiece 2, the filling duct 3 has a smaller cross section at its entrance mouth 4 than at its outlet mouth 5.

To construct the mouthpiece 2 more easily on the basis of considerations detailed below, the mouthpiece 2 is made in two mouthpiece halves 6 and 7, which, as indicated in FIGS. 2 and 3, can contact each other on the symmetry axis 8 and can be detachably secured to each other by screws 9.

On the upper end the mouthpiece 2 has a substantially cylindrical coupling piece 11, to which a substantially trapezoidal supporting member 12 connects. A pin-like outlet piece 13 rounded on bottom is connected below the supporting member 12.

The lower outlet mouth 5 may be closed or opened by a flexible cutoff band 14. For this purpose the cutoff band 14 formed as a steel band is provided with a permeable window 15, which has substantially the same dimensions as the outlet mouth 5. Each free end of the cutoff band 14 is attached through bolts 42*a* and 42*b* to one of two carriages 16, 17, which can move to and fro in T-grooves 18, 19 in the supporting member 12. Hence coupled to and fro motion the permeable window 15 may be brought into the vicinity of the outlet mouth 5, so that the product can flow from the mouthpiece 2 into the container found under it. When the window 15 is not in the vicinity of the outlet mouth, the outlet mouth is of course closed.

To guarantee a satisfactory guiding of the cutoff band 14, it is guided in passages 20, which are provided in the outlet piece 13. The T-grooves 18,19 are located in the supporting member 12 at an angle of about 20 degrees to the filling axis (which is the longitudinal direction of the outlet piece 13).

As indicated in FIG. 3 a blind hole 21 is provided in one of the mouthpiece housing halves 7, whose significance is explained in more detail below.

FIGS. 4 to 6 show two adjacent parallel mouthpieces 2, which are connected to each other by a common supporting shaft 22. This supporting shaft 22 acts to support the twin-armed operating levers 23 associated with mouthpieces 2. One arm 24 of each lever 23 with a bolt 25 cooperates with a receptacle 26 engaged with the bolt 25 and the other arm 27 with an appropriately formed bolt 28 cooperates with another receptacle 29 of the other carriage 17 in which the bolt 28 is engaged. A hydraulic piston cylinder unit 43 operates to mechanically drive carriage 16 via lever arm 24. Carriage 17 is driven through action of spring 44 on lever arm 27.

By pivoting of the operating lever 23, the carriages 16, 17 are moved back and forth in the T-grooves 18, 19 by the bolts 25,28 and because of that the cutoff band not shown in FIG. 4 moves along the outlet mouth 5 of the mouthpiece 2.

The supporting shaft 22 is mounted in the housing halves 7 and 6 opposite each other of one and the other mouthpiece 2. As seen in the mouthpiece 2 shown on the right in FIG. 6, the supporting shaft 22 is mounted in a sleeve 29, which sits in the blind hole 21 of the mouthpiece 2. The appropriate support or mounting of the mouthpiece 2 shown on the left side is not detectable.

While a stop or lock lever 31 is mounted on the supporting shaft 22 in the vicinity of the right mouthpiece 2, which is screwable on the associated operating lever 23, a drive lever 32 is mounted in the vicinity of the operating lever 23 in the vicinity of the other, left mouthpiece 2. The drive lever 32 is held clamped on the supporting shaft 22 and is provided with a pin 33, which is in working connection with a guide slot 34 of a rod 35. The total drive of the operating mechanism can occur thereby.

Our invention is not limited to the above embodiment, but many variations are possible within its scope as defined in the appended claims. Thus it is also possible to provided each carriage with a suitable cutoff band. The free ends of these cutoff bands are positioned at the height of the outlet mouth and are either pushed apart or overlapped so that in this way an opening and closing of the outlet mouth is possible. Similarly the cutoff band can be equipped with two permeable windows for half-turn operation. Finally the cutoff band may be made from a flexible plastic material or from other suitable materials. A simplified structure is conceivable in which only one cutoff band with one carriage is used. Finally the housing need not be made from two housing halves, but instead a cavity can be provided in a single-piece housing, in which an insert can be mounted leaving a guide groove for the cutoff band.

We claim:

1. In an apparatus for filling a container with a measured amount of a liquid, pasty or lumpy product with at least one mouthpiece having a filling duct whose outlet mouth is closable by a closure member, the improvement wherein said closure member comprises at least one cutoff band and means for displacing said band relative to said mouth, and wherein said means for displacing further comprises a carriage slidably mounted in a guide of said mouthpiece, said cutoff band is attached to said carriage at an end facing away from said outlet mouth, said cutoff band is formed of steel, flexible and is guided in a passage about said outlet mouth, said cutoff band is slidable in a vicinity of said outlet mouth in and opposite a transport direction of said container, and said passage is positioned in an elongated outlet piece of said mouthpiece which is rounded on its bottom portion.

2. The improvement according to claim 1 in which said elongated outlet piece is connected to said filling apparatus by a supporting member and said guide comprises a T-groove which is positioned in the supporting member.

3. The improvement according to claim 2 in which said mouthpiece comprises a mouthpiece housing divided at a symmetry axis of said T-groove and whose mouthpiece housing halves are secured by screws or the like detachably with each other.

4. The improvement according to claim 3 in which said T-groove is a substantially trapezoidal shaped supporting member and said cutoff band is provided with at least one permeable window in a central region associated with said outlet mouth of said mouthpiece of said filling apparatus.

5. The improvement according to claim 4 in which said permeable window has approximately the same dimensions as a cross section of said filling duct of said mouthpiece.

6. The improvement according to claim 5 in which said filling duct has an increasingly larger cross section going from an entrance mouth thereof to said outlet mouth.

7. The improvement according to claim 6 in which said T-grooves for said carriages are oriented inclined to a filling axis at an angle of about 20 degrees.

8. The improvement according to claim 7 in which said cutoff band is attached to two of said carriages mounted on opposite sides of said outlet mouth of said mouthpiece, which cooperate together at the free ends of said cutoff band in the vicinity of said outlet mouth.

9. The improvement according to claim 8 in which at least one of said carriages is driven mechanically and at least one other of said carriages is spring-loaded.

10. The improvement according to claim 9 in which said carriages are driven by a common twin-armed operating lever in opposite directions.

11. The improvement according to claim 10 in which said carriages are provided with a receptacle open on one side and said twin-armed operating lever is provided with two bolts each of which is engaged in one of said receptacles.

12. The improvement according to claim 11 in which a central supporting shaft for said operating levers extends transversely to the transport direction of said container.

13. The improvement according to claim 12 in which at least one operating lever is provided rigidly attached with said supporting shaft.

14. The improvement according to claim 13 in which two of said mouthpieces are mounted on each end of said supporting shaft with associated ones of said carriages, one of said cutoff bands and said operating mechanism.

15. An apparatus for filling a container with a measured amount of a liquid, pasty or lumpy product comprising at least one mouthpiece having a supporting member on a side thereof and a filling duct whose outlet mouth is closable by at least one flexible steel cutoff band guided in a passage in a vicinity of said outlet mouth in an elongated outlet piece of said mouthpiece which is rounded on its bottom portion, said cutoff band being slidable in the vicinity of said outlet mouth of said mouthpiece in and opposite a transport direction of said container in said apparatus for filling, a carriage guided slidably in a T-groove of the supporting member and attached at one end to said cutoff band to drive said cutoff band.

16. An apparatus for filling a container with a measured amount of a liquid, pasty or lumpy product with at least one mouthpiece having a substantially trapazoidal-shaped supporting member on a side thereof and a filling duct with an increasingly larger cross section going from an entrance mouth along a filling axis to an outlet mouth, said outlet mouth being closable by at least one flexible cutoff band, said cutoff band being provided with at least one permeable window in a central region associated with said outlet mouth of said mouthpiece of said filling apparatus and each end of said cutoff band being connected to a carriage guided slidably in a T-groove in the supporting member of said filling apparatus inclined to said filling axis at an angle of about 20 degrees, at least one of said carriages being driven mechanically and at least one other of said carriages being spring-loaded, said carriages being driven by a common twin-armed operating lever having a bolt engaged in a receptacle on one side of each of said carriages.

* * * * *